US005566552A

United States Patent [19]

Cheng

[11] Patent Number: 5,566,552

[45] Date of Patent: Oct. 22, 1996

[54] VAPOR PRESSURE ENHANCEMENT (VPE) DIRECT WATER CHILLING-HEATING PROCESS AND APPARATUSES FOR USE THEREIN

[76] Inventor: Chen-Yen Cheng, 10308 Paddington Ct., Ellicott City, Md. 21042

[21] Appl. No.: 503,874

[22] Filed: Jul. 17, 1995

Related U.S. Application Data

[63] Continuation-in-part of Ser. No. 295,771, Aug. 29, 1994, Pat. No. 5,526,653.

[51] Int. Cl.[6] ..... B01D 9/04

[52] U.S. Cl. ..... 62/534; 62/123; 62/937

[58] Field of Search ..... 62/534, 123, 937

[56] References Cited

U.S. PATENT DOCUMENTS 4,810,274 3/1989 Cheng et al. ..... 62/532

5,061,306 10/1991 Cheng ..... 62/532

*Primary Examiner*—Ronald C. Capossela

[57] ABSTRACT

A Vapor Pressure Enhancement Direct Water Chiller, designated as a VPE chiller, a Vapor Pressure Enhancement Direct Water Heater, designated as a VPE heater, and a dual purpose integrated Vapor Pressure Enhancement Direct Water Chiller/Heater, designated as a VPE chiller/heater are introduced. A VPE-chiller comprises multiple pressure processing zones and is based on absorption vapor pressure enhancement operation. It comprises multitude of processing zones, Z-1, Z-2, . . . , Z-N that are operated under pressure $P_1$, $P_2$, . . . , $P_N$. Each pressure zone (Z-n) contains a water evaporation zone (Z-En), a vapor pressure enhancement zone (Z-VPEn) and a second vapor condensing zone (Z-Xn). There are a set of rotating discs to provide water evaporation surfaces in the evaporation zone; there are flat heat conductive tubes for forming falling films of absorbing solution and falling films of water in the vapor pressure enhancement zone; there are condenser tubes in the condensation zone. A first vapor is absorbed and second vapor is generated in the enhancement zone; the second vapor is condensed in the condensing zone. Outdoor air, cooling water or air/water combination is used to remove the heat of condensation. The construction and operations of a VPE heater is similar to that of a VPE chiller.

20 Claims, 9 Drawing Sheets

Section A–A

Section A–A

VAPOR PRESSURE ENHANCEMENT (VPE) DIRECT WATER CHILLING-HEATING PROCESS AND APPARATUSES FOR USE THEREIN

RELATED APPLICATION

This application is a continuation in part of U.S. Ser. No. 08/295,771 filed Aug. 29, 1994 now U.S. Pat. No. 5,526, 653.

BACKGROUND OF THE INVENTION

1. Field of Invention

The process and apparatus of the present invention are related to adiabatic water chilling and heating operations coupled with absorption vapor pressure enhancement operations.

2. Brief Description of the Prior Art

A large scale absorption air conditioning process comprises (a) a step of producing a stream of chilled liquid such as water or an aqueous solution of ethylene glycol at around 7.2° C. (45° F.), in an absorption liquid chiller and (b) a step of circulating a stream of the chilled liquid through air handlers to remove heat from indoor air and thereby return the liquid at around 15.5° C. (60° F.). Manufacturers of absorption chillers are Trane Corp. in Wisconsin and Carrier Corp. in New York State . There are several manufacturers in Japan including Sanyo, Ebara, Mitsubishi and Yasaki. A commercial absorption liquid chiller has a large vacuum enclosure enclosing (a) an evaporation zone, (b) an absorption zone, (c) a regeneration zone and (d) a condensation zone. The processing steps are as follows:

(a) As water enters the evaporation zone, flash vaporization causes formation of a first vapor and a mass of internal chilled water at around 4.4° C. (40° F). An external chill water at a first temperature around 15.5° C. (60° F.) then exchanges heat with the internal chill water and is thereby cooled to a second temperature at around 7.2° C. (45° F.).The chilled external chill water is then circulated to air handlers and heated to the first temperature and returned to the liquid chiller;

(b) The water vapor is drawn to the absorption zone and is absorbed in a strong absorbing solution such as 63% aqueous lithium bromide solution. The absorbing solution is thereby diluted and becomes a weak absorbing solution, say 58% lithium bromide. The heat of absorption is released to a cooling water stream;

(c) The weak absorbing solution then enters the regeneration zone, wherein it is heated and vaporized to generate a near ambient pressure water vapor and becomes a strong absorbing solution that is heat exchanged and returned to the absorbing zone;

(d) The near ambient pressure water vapor is condensed by rejecting heat to a cooling water stream and the condensate formed is heat exchanged and returned to the evaporation zone.

The operations in a small conventional absorption air conditioner are similar to those of a larger unit described, except that the internal chilled water produced in the evaporation zone is circulated directly to an air handler.

An Immediate Heat Upgrading Absorption Air Conditioning System. (IHUA System ) has been introduced by Chen-Yen Cheng and has been described in U.S. Pat. No. 5,209, 071 and corresponding international applications. The system uses Immediate Heat Upgrading Absorption Air Handlers (IHUA air handlers). In this system, an absorption solution consisting of a common salt and water is circulated through the IHUA air handlers to upgrade heat taken from a first air mass or water and release the upgraded heat to a second air mass immediately. Production of chilled water is avoided. An IHUA air handler has one or more Modular Evaporation-Absorption panels (E-A panels) with two sets of heat transfer fin assemblies. An E-A panel has two closely spaced heat conductive walls enclosing a film evaporative zone and a film absorption zone that respectively exchange heat with air to be cooled and air to be heated through the two sets of fin assemblies. A multiple pressure zone IHUA air handler and multiple pressure zone evaporation and absorption operations have been described. It is noted that the present application is a continuation in part application of a co-pending U.S. application Ser. No. 08/295,771, which is a continuation application of U.S. application Ser. No. 851,298 that has become the U.S. Pat. No. 5,209,071 described.

BRIEF DESCRIPTION OF THE INVENTION

A Vapor Pressure Enhancement Direct Water Chiller, designated as a VPE chiller, a Vapor Pressure Enhancement Direct Water Heater, designated as a VPE heater, and a dual purpose integrated Vapor Pressure Enhancement Direct Water Chiller/Heater, designated as a VPE chiller/heater are introduced.

An air conditioning system for a building may have one or more evaporators, referred to as regenerators, for regenerating absorbing solution. A regenerator may concentrate enough absorbing solution to be used in several VPE chillers, VPE heaters or VPE chiller/heaters. Then, a VPE chiller may supply enough chill water for use in a multitude of air handlers for room cooling. Similarly, a VPE heater may supply enough warm water for use in a multitude of air handlers for room heating. Of course, a VPE chiller/heater can be used for both cooling and heating of a building and may be use in combination with several air handlers. Such a central air conditioning system may be properly coordinated for good economy and convenience.

A VPE chiller produces a stream of system chill water by flash vaporizing a stream of system water under a first low pressure. The water vapor generated is referred to as a first vapor and also as an inner water vapor. The inner water vapor is absorbed into an absorbing solution at an elevated temperature and the heat of absorption is utilized to generate a second vapor that is also refer to as an outer water vapor at a second pressure that is substantially higher than the first pressure. The outer water vapor is condensed by releasing heat of condensation to outdoor air or cooling water. Evaporative condensers may be used to condense the outer water vapor. The diluted absorbing solution is concentrated by an evaporation operation in an absorbing solution regenerator. The transformation from the inner water vapor to the outer water vapor is referred to as an absorption vapor pressure enhancement operation and also simply as a VPE operation. Since the inner vapor and the outer vapor are the inlet vapor and outlet vapor for the VPE operation in the VPE chillier, they are respectively referred to as the first vapor and second vapor of the VPE operation.

A VPE heater produces a stream of system heated water by condensing an inner water vapor to be described into a stream of system water under a near adiabatic condition. First of all, heat is taken in from the environment, for example, from the outdoor air, lake water and river water and some waste heat sources, into the VPE heater to vaporize water under a first pressure to thereby generate a low pressure water vapor. The vapor generated is referred to as an outer water vapor. The outer water vapor is absorbed into an absorbing solution at an elevated temperature and the heat of absorption is utilized to generate a water vapor at a second pressure that is substantially higher than the first pressure. The vapor generated becomes the inner water vapor used to heat the system water.

The transformation from the outer water vapor to the inner water vapor is also an absorption vapor pressure enhancement (VPE) operation. Since the outer vapor and the inner vapor are respectively the inlet vapor and outlet vapor of the VPE operation, they are respectively referred to as the first and the second vapor of the VPE operation.

Some terminologies that are used in relation to both a VPE chiller and a VPE heater are summarized as follows:

(a) "An adiabatic liquid-vapor interaction" refers both to the flash vaporization in a VPE chiller and the adiabatic condensation of the inner water vapor into the system water in a VPE heater.

(b) "Heat interaction with the environment" refers both to removing heat of condensation by outdoor air or cooling water in a VPE chiller and generation of outer vapor by vaporizing water upon receiving heat from outdoor air or any low temperature heat source in a VPE heater.

(c) "An adiabatic liquid-vapor interaction zone" refers both to the flash vaporization zone of a VPE chiller and the adiabatic inner vapor condensation zone of a VPE heater.

(d) "An environmental heat interaction zone" refers both to the second vapor condensing zone in a VPE chiller and the outer water vapor generation zone in a VPE heater.

(e) "An inner water vapor" refers both to the vapor formed in flash vaporization of the system water in a VPE chiller and the vapor to be condensed into the system water in a VPE heater.

(f) "An outer water vapor" refers both to the second vapor to be condensed by heat interaction with the environment in a VPE chiller and the vapor produced by heat interaction with the environment in a VPE heater.

A VPE chiller may be divided into a multitude of pressure zones and multiple pressure zone operations may be used to conduct the flash vaporization, first vapor (inner vapor) absorption, second vapor (outer vapor) generation and second vapor (outer vapor) condensation operations. Such a VPE Chiller may be referred to as a Vapor Pressure Enhancement Multiple Pressure Zone Direct Water Chiller and also referred to as a VPE/MPZ Direct Water Chiller or simply as a VPE/MPZ Chiller.

A VPE-MPZ chiller comprises multiple processing sub-zones, Z-1 through Z-N. Each pressure sub-zone (Z-n) contains a water evaporation zone (Z-En), a vapor pressure enhancement zone (Z-VPEn) and a second vapor condensing zone (Z-Xn).

There are one or more sets of rotating discs or other packing device to provide water evaporating surfaces in the evaporation zone; there are parallel vertical walls or flat tubes made of heat conductive material for forming falling absorbing solution films and forming falling water films in the vapor pressure enhancement zone; there are condenser tubes in the condensation zone to condense the second vapor. In a Type A system, outdoor air is used to remove the heat of condensation and heat transfer fins are provided on the condenser tubes. In a Type B system, cooling water passes inside of the condenser tubes to thereby condense the second vapor outside of the tubes.

The following operational steps take place in each pressure zone:

(1) Water is vaporized in each evaporation zone to generate a first vapor (inner vapor) and chill the water;

(2) The first vapor (inner vapor) is absorbed and a second vapor (an outer vapor) is generated in each vapor pressure enhancement zone;

(3) The second vapor (outer vapor) is condensed in each condensing zone;

(4a) In a Type A VPE/MPZ chiller, a stream of outdoor air flows through the fins to remove the heat of condensation;

(4b) In a Type B VPE/MPZ chiller, a stream of cooling water flows through the condenser tubes to remove the heat of condensation.

A VPE heater may also be divided into multiple pressure zones and multiple pressure zone operations may be used to conduct the heat interactions with the environment, such as outdoor air, and various heat sources, outer vapor generation, outer vapor absorption, inner vapor generation and near adiabatic inner vapor condensation into the system water. Such a VPE heater may be referred to as a Vapor Pressure Enhancement Multiple Pressure Zone Direct Water Heater and also referred to as a VPE/MPZ Direct Water Heater or simply as a VPE/MPZ heater. The structure of a VPE/MPZ heater is very similar to that of a VPE/MPZ chiller. A dual purpose VPE/MPZ chiller/heater can be used as a VPE/MPZ chiller and a VPE/MPZ heater by simply changing the flows of absorbing solution and water streams.

A VPE chiller-heater may be used both as a VPE chiller and a VPE heater. A VPE chiller may be divided into a multitude of pressure zones and a multiple pressure zone operations may be used to conduct the flash vaporization first vapor absorption, second vapor generation and second vapor condensation operations described. Such a VPE chiller may be referred to as a Vapor Pressure Enhancement Multiple Pressure Zone Direct Water Chiller and also referred as a VPE/MPZ Direct Water Chiller or simply as a VPE/MPZ chiller.

Figure 2:
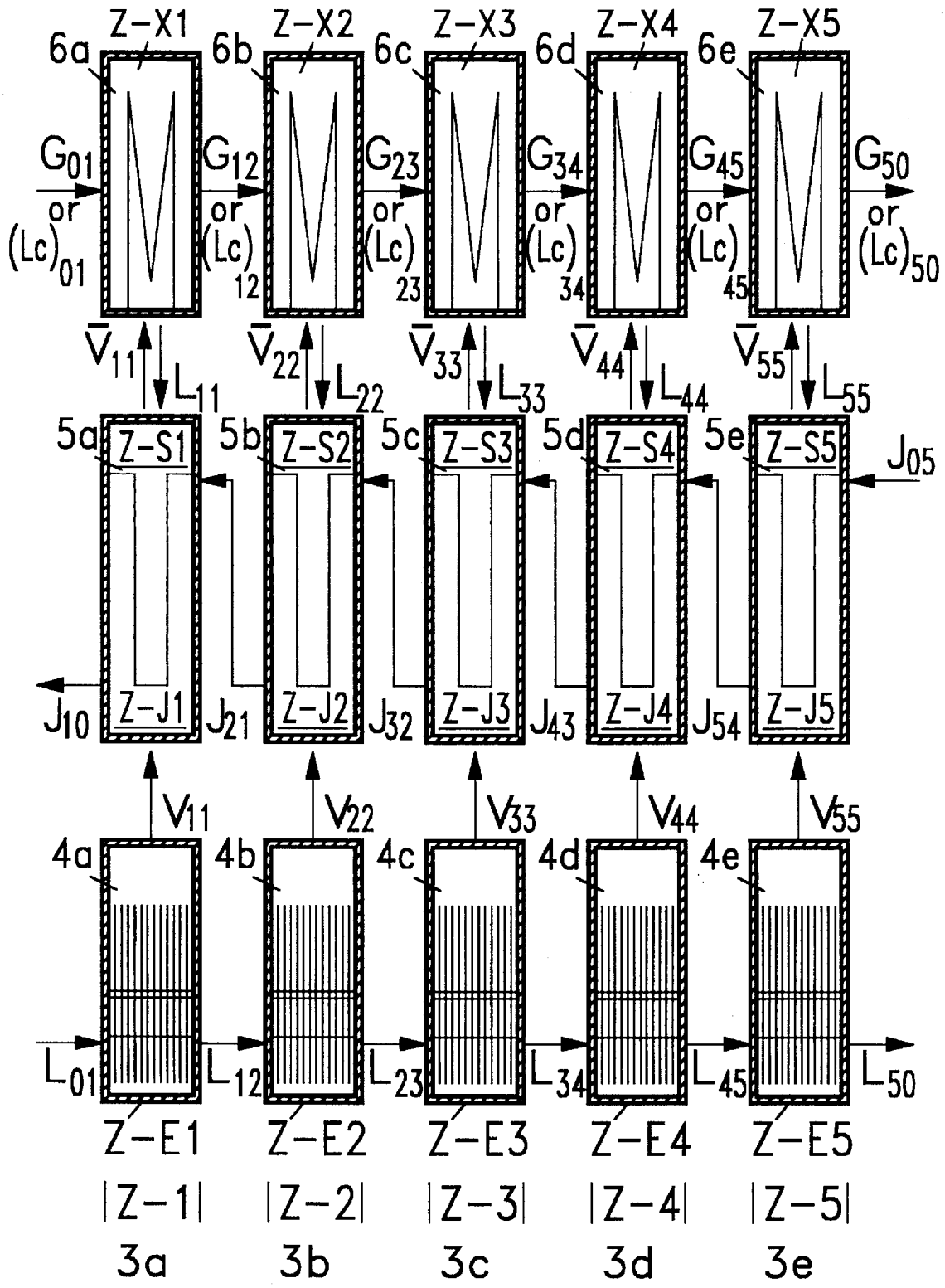

FIG. 2 illustrates the structure and operations of a VPE/MPZ chiller. Five pressure zone unit is illustrated.

Figure 3:
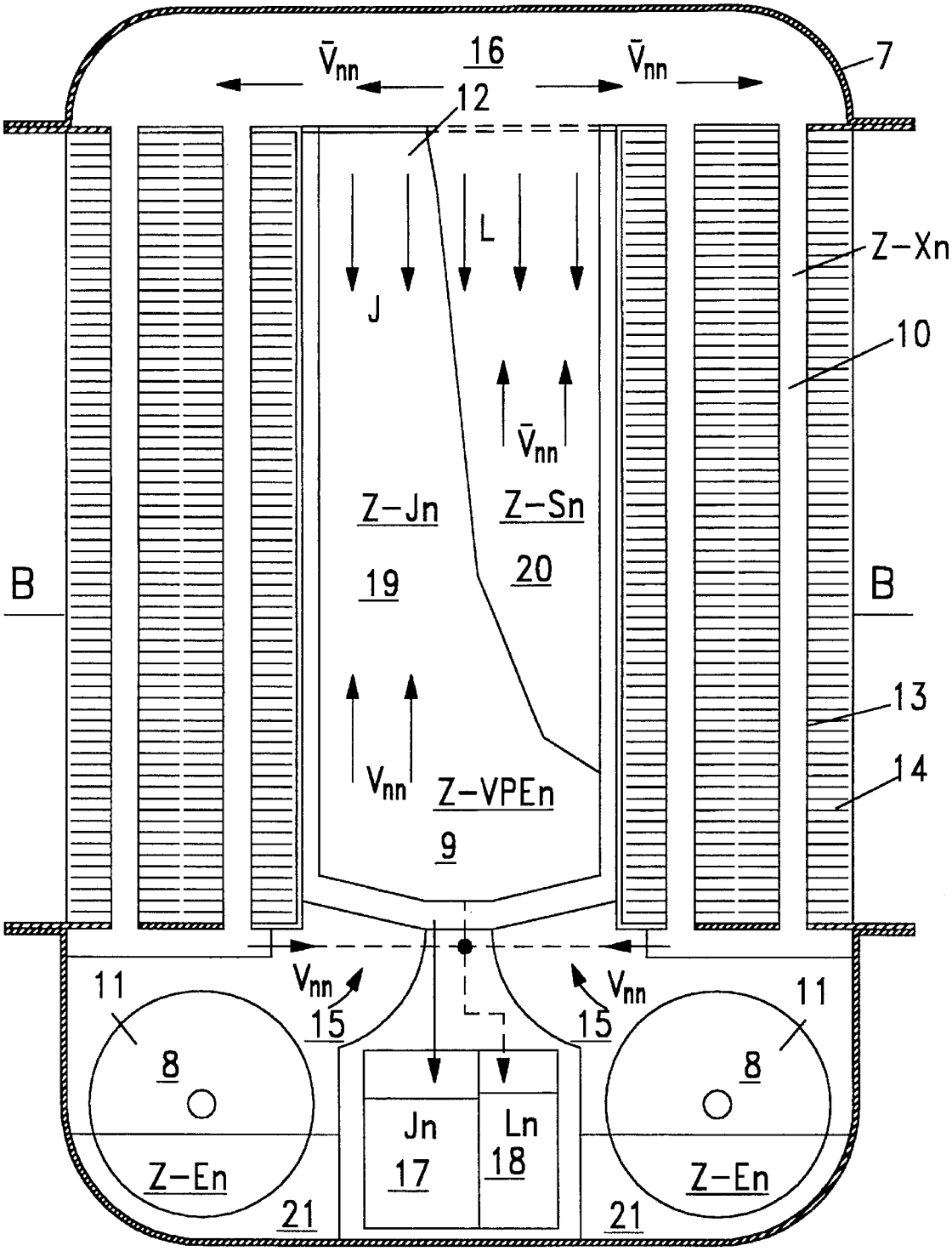
Figure 4:
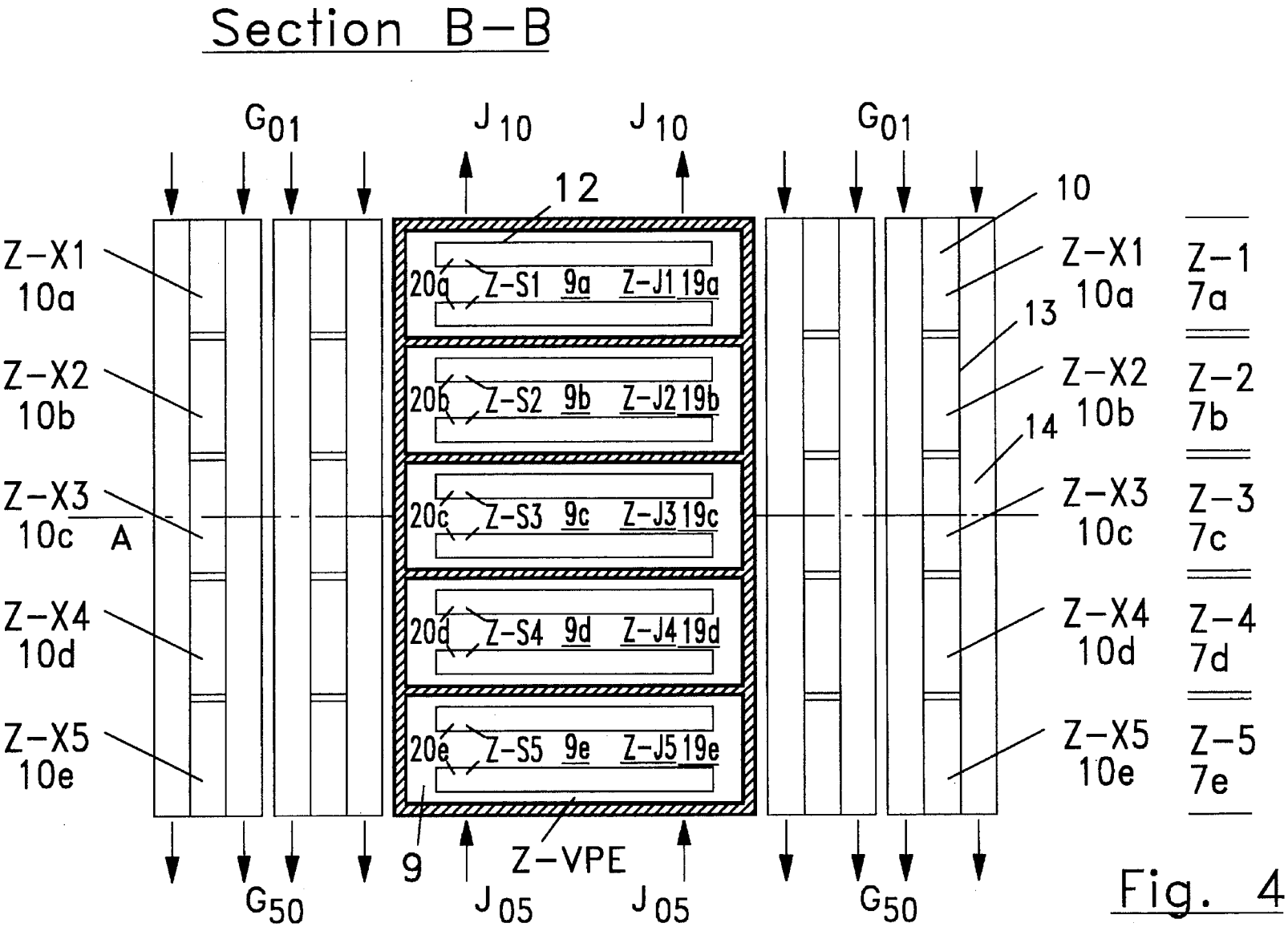

FIG. 3 and 4 respectively illustrate a vertical cross-section, Section A—A, and a horizontal cross-section, Section B—B of a Type A VPE-MPZ Direct Water chiller. Referring to these figures, a Type A VPE-MPZ chiller comprises a vacuum enclosure and multiple pressure processing sub-zones. In the Figures, five processing sub-zones Z-1, Z-2, Z-3, Z-4 and Z-5 are illustrated. Each pressure sub-zone (Z-n) contains a water evaporation zone (Z-En), a vapor pressure enhancement zone (Z-VPEn) and a second vapor condensation zone (Z-Xn).

There are one or more sets of rotating discs or other packing devices to provide water evaporating surfaces in the evaporation zone; there are flat tubes made of heat conductive material for forming falling absorbing solution films and forming falling and evaporating water films in the vapor pressure enhancement zone; there are condenser tubes and heat transfer fins in the condensation zone to condense the second vapor.

In operation, the following operational steps take place in each pressure zone:

(1) Water is vaporized in each evaporation zone to generated a first vapor and chill the water;

(2) The first vapor is absorbed and a second vapor is generated in each vapor pressure enhancement zone;

(3) The second vapor is condensed in each condensing zone;

(4) A stream of outdoor air flow through the fins to remove the heat of condensation.

Figure 5:
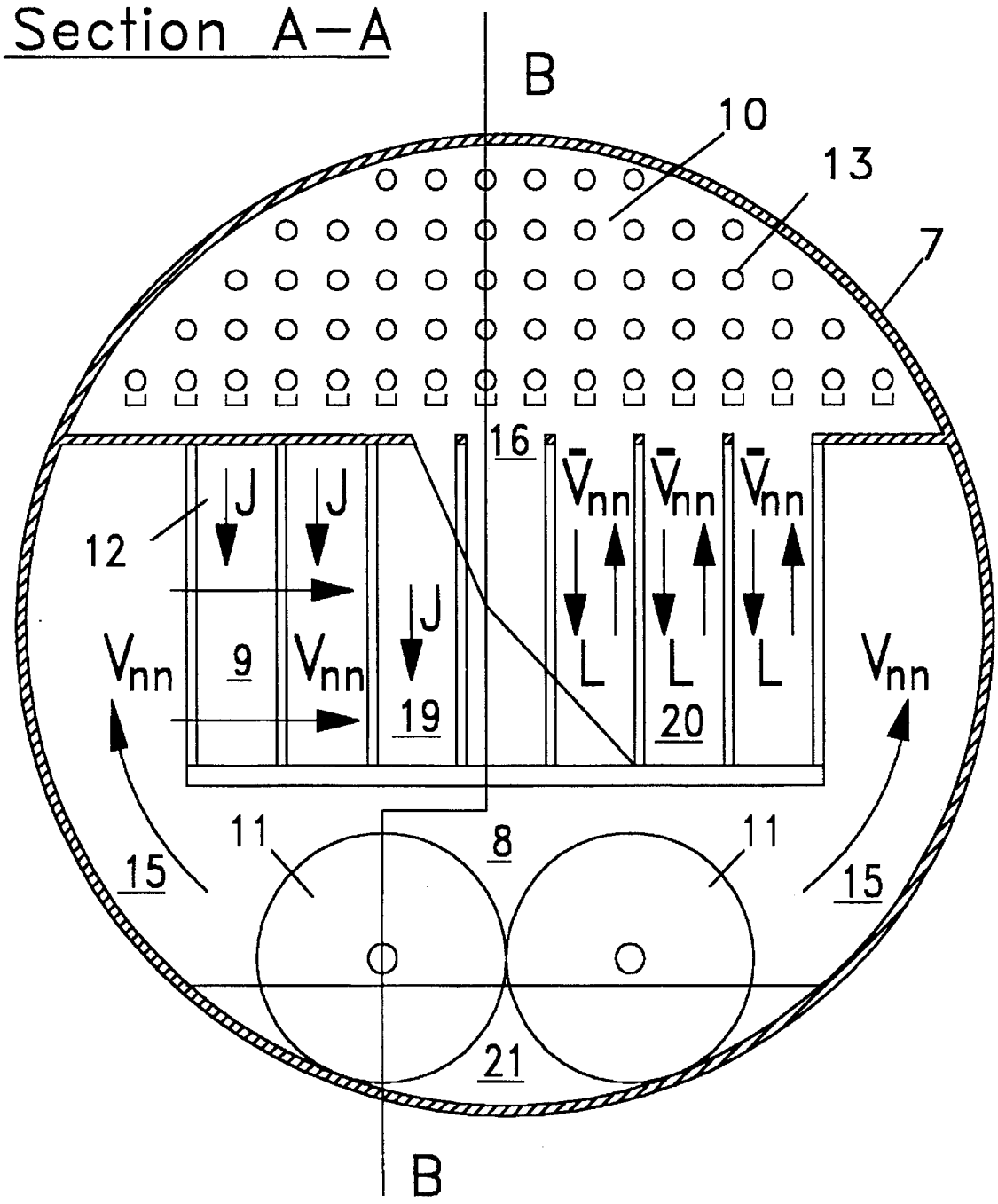
Figure 6:
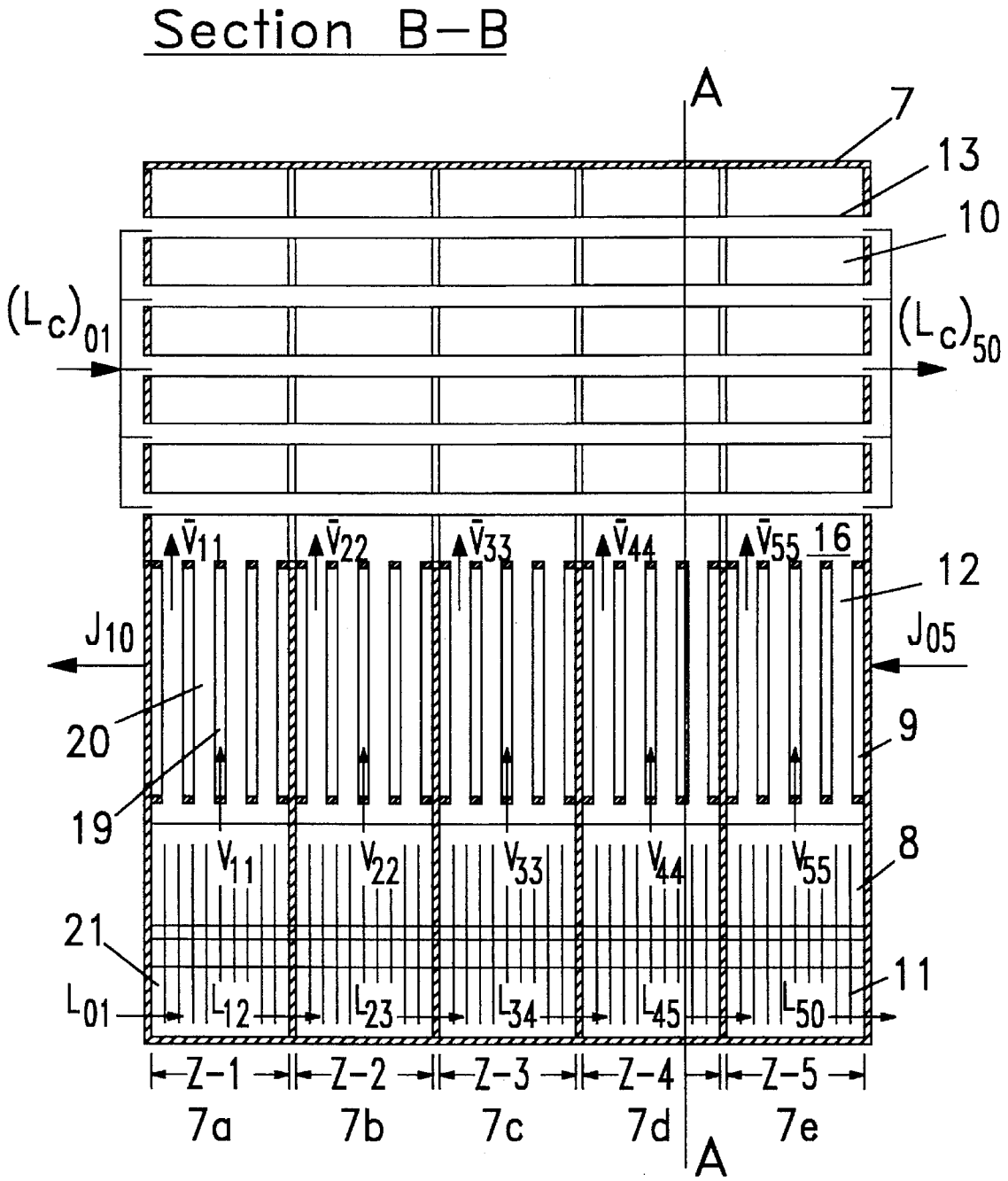

FIGS. 5 and 6 respectively illustrate a vertical cross-section, taken perpendicular to the radial direction, Section A—A; and a vertical cross-section, taken parallel to the longitudinal direction, Section B—B of a Type B VPE-MPZ Direct Water Chiller. Referring to these figures, a Type B VPE-MPZ chiller comprises a horizontal vacuum enclosure and multiple pressure processing sub-zones. In the Figure, five processing sub-zones Z-1, Z-2, Z-3, Z-4 and Z-5 are illustrated. Each pressure sub-zone (Z-n) contains a water evaporation zone (Z-En), a vapor pressure enhancement zone (Z-VPEn) and a second vapor condensing zone (Z-Xn).

There are one or more sets of rotating discs, two sets being shown, or other packing devices to provide water evaporating surfaces in the evaporation zone; there are flat tubes made of heat conductive material for forming falling absorbing solution films and forming falling evaporating water films in the vapor pressure enhancing zone; there are condenser tubes in the condensation zone. Cooling water passes through the tubes to condense the second vapor. There are vapor passages for transferring vapor from the evaporation zone (Z-En) to the vapor pressure enhancing zone (Z-VPEn); there are vapor passages for transferring vapor from the vapor pressure enhancing zone (Z-VPEn) to the vapor condensing zone (Z-Xn). In each vapor pressure enhancing zone, there is a first vapor absorption zone (Z-Jn) and a vapor generation zone (Z-Sn). The former zone is the zone outside of the flat tubes and the latter zone is the zone inside of the flat tubes. There is a pool of water in the evaporation zone (Z-En).

The operational steps conducted in the system of FIGS. 5 and 6 are similar to these of the system of FIGS. 3 and 4 except that cooling water is used in removing the heat of condensation of the second vapors.

A VPE heater may also be divided into a multitude of pressure zones and a multiple pressure zone operations may be used to conduct the outer water vapor generation, the vapor pressure enhancement operation transforming the outer water vapor into the inner water vapor and condensation of the inner water vapor into the system water. Such a VPE heater may be referred to as a Vapor Pressure Enhancement Multiple Pressure Zone Direct Water Heater and also referred as a VPE/MPZ Direct Water Heater or simply as a VPE/MPZ heater.

Figure 7:
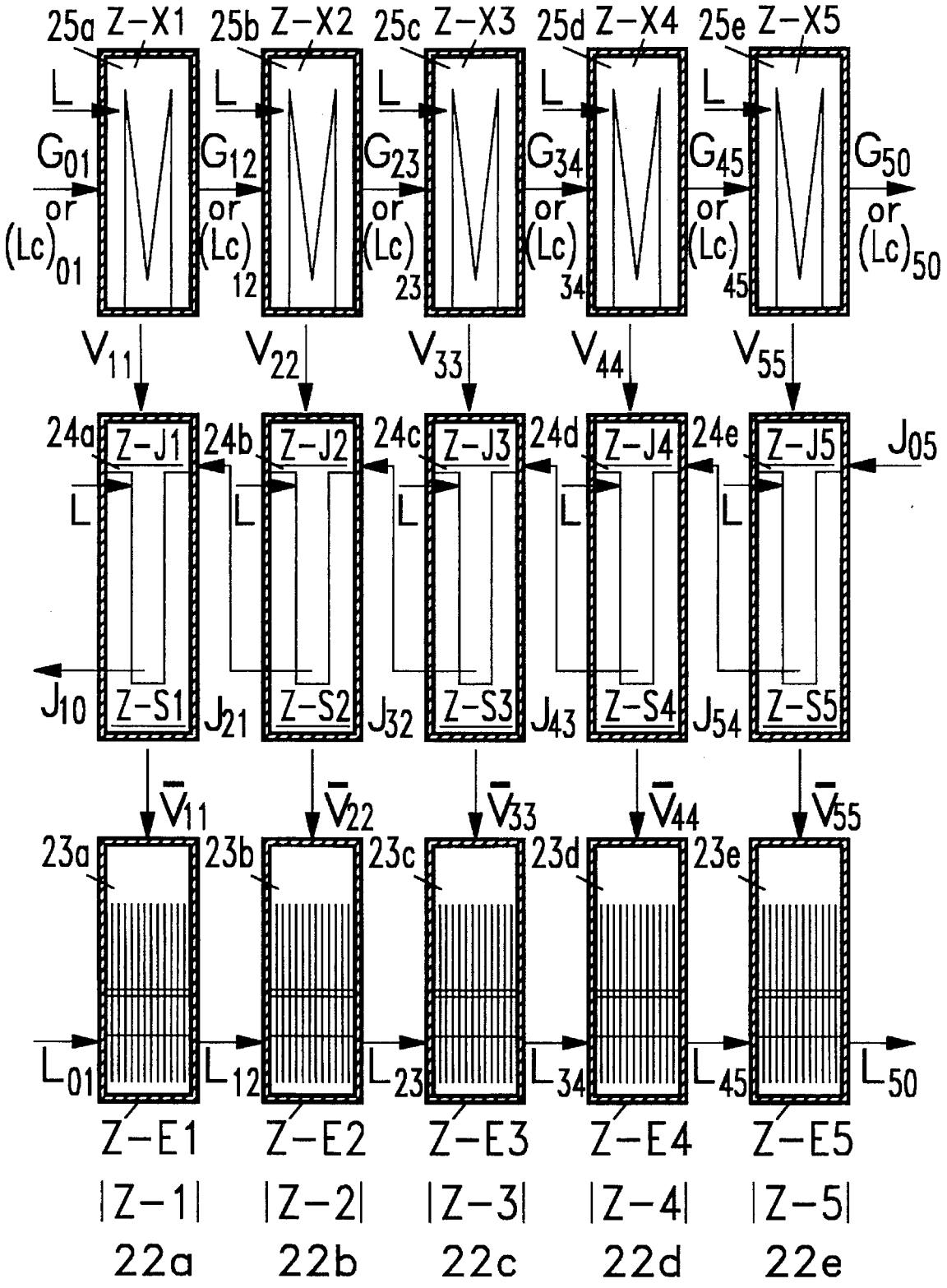

FIG. 7 illustrates the structure and operations of a VPE/MPZ heater. Five pressure zone unit is illustrated.

Figure 8:
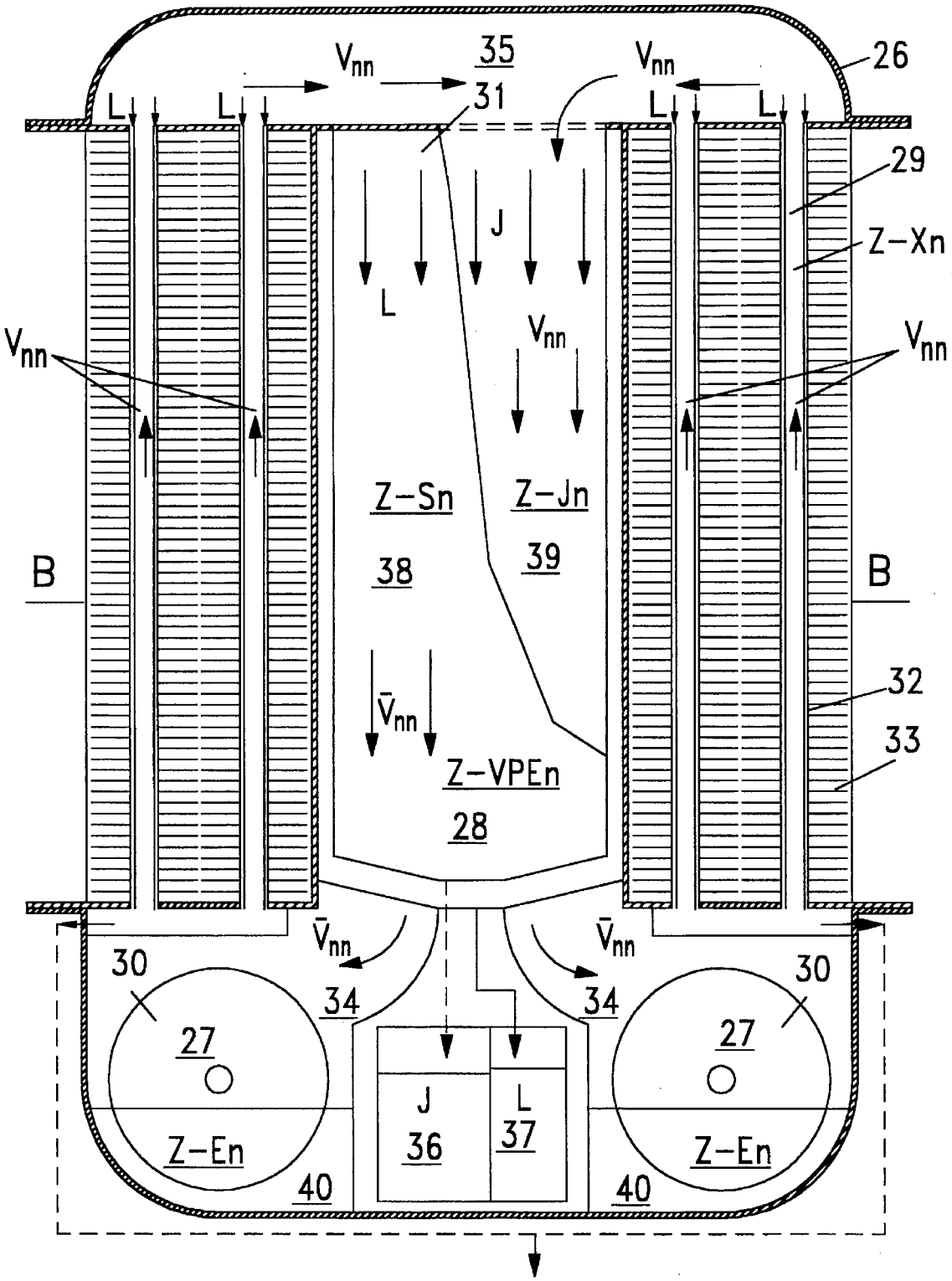
Figure 9:
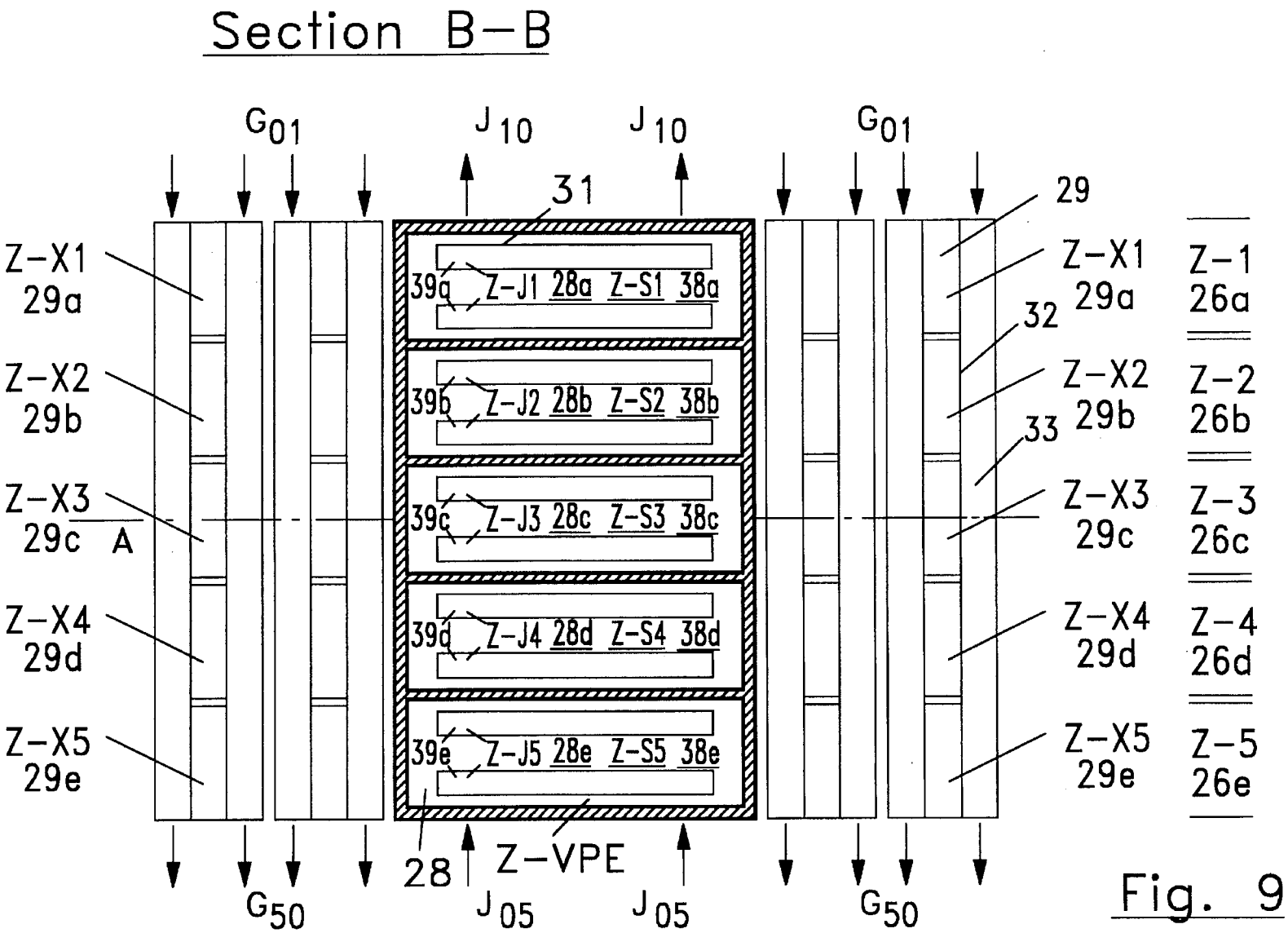

FIG. 8 and 9 respectively illustrate a vertical cross-section, Section A—A, and a horizontal cross-section, Section B—B of a Type A VPE-MPZ Direct Water Heater. Referring to these figures, a Type A VPE-MPZ heater comprises a vacuum enclosure and multiple pressure processing sub-zones. In the figures, five processing sub-zones Z-1, Z-2, Z-3, Z-4 and Z-5 are illustrated. Each pressure sub-zone (Z-n) contains an adiabatic liquid-vapor interaction zone (Z-En), a vapor pressure enhancement zone (Z-VPEn) and a heat interaction zone (Z-Xn).

There are one or more sets of rotating discs or other packing devices to provide vapor-liquid interaction surfaces in the adiabatic liquid-vapor interaction zone (Z-En); there are flat tube or parallel vertical walls made of heat conductive material for forming falling absorbing solution films and forming falling and evaporating water films in the vapor pressure enhancement zone (Z-VPEn); there are heat transfer tubes and heat transfer fins in the heat interaction zone (Z-Xn) to generate the outer water vapor.

In operation, the following operational steps take place in each pressure zone:

(1) In each heat interaction zone Z-Xn, heat is received from the outdoor air or other low temperature heat sources to generate an outer water vapor $\overline{V}_{nn}$;

(2) The outer water vapor $\overline{V}_{nn}$ is absorbed and an inner water vapor $V_{nn}$ is generated in each vapor pressure enhancement zone (Z-VPEn);

(3) The inner vapor $V_{nn}$ is condensed and the system water is heated in each adiabatic liquid-vapor interaction zone (Z-En).

PREFERRED EMBODIMENT OF THE INVENTION

Figure 1:
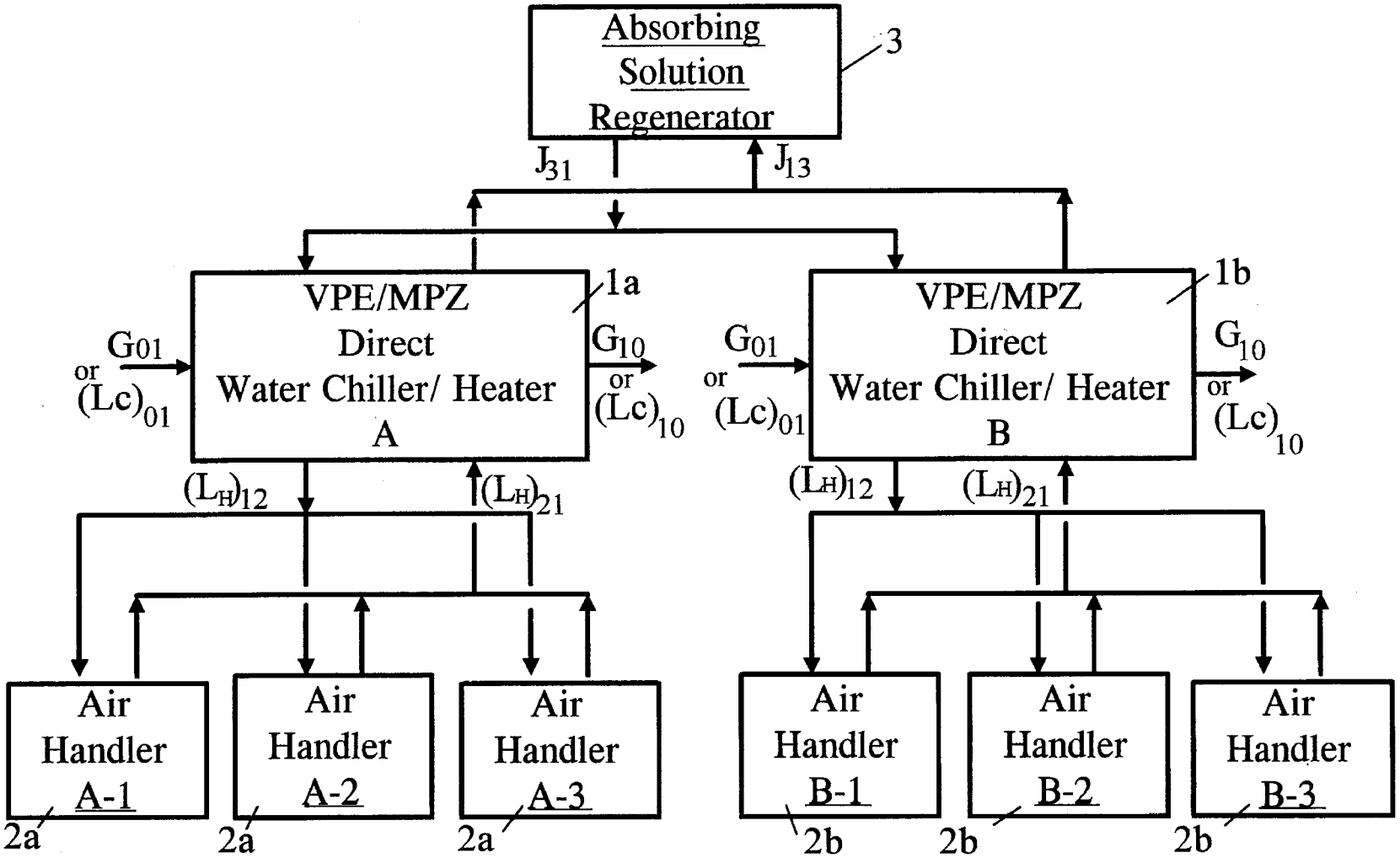
FIG. 1 illustrates a system for providing air conditioning in a building with a multitude of air handlers. The system comprises one or more Vapor Pressure Enhancement Direct Water Chiller-Heaters, designated as VPE chiller-heaters. A VPE chiller produces chill water by flash vaporizing water under a low pressure and a low temperature. A first low pressure water vapor (inner water vapor) is generated. The chill water is circulated through the air handlers and recycled back to the VPE chillers. The first water vapor is absorbed into an absorbing solution at an elevated temperature and the heat of absorption is utilized to generate a second water vapor (outer water vapor) at a second pressure that is higher than the first pressure. The second water vapor is condensed by releasing heat of condensation to outdoor air or cooling water. Evaporative condensers may be used to condense the second vapor. The diluted absorbing solution is concentrated by an evaporation operation in an absorbing solution regenerator. A VPE heater produces a stream of system heated water by condensing an inner water vapor to be described into a stream of system water under a near adiabatic condition. First of all, heat is taken in from the environment, for example, from the outdoor air, lake water and river water and some low temperature heat source, into the VPE heater to vaporize water under a first pressure to thereby generate a low pressure water vapor. The vapor generated is referred to as an outer water vapor. The outer water vapor is absorbed into an absorbing solution at an elevated temperature and the heat of absorption is utilized to generate a water vapor at a second pressure that is substantially higher than the first pressure. The vapor generated becomes the inner water vapor used to heat the system water.

FIG. 1 illustrates a system for providing air conditioning in a building with a multitude of air handlers. It comprises one or more Vapor Pressure Enhancement Direct Water Chiller/Heaters 1*a*, 1*b*, designated as a VPE chiller/heaters. A VPE chiller/heater is a dual purpose unit that can be used as a chiller or a heater by simple adjustments of the flows of absorbing solutions and water. A VPE chiller produces chill water $(L_H)_{12}$ by flash vaporizing system water under a low pressure and a low temperature, respectively referred to as a first pressure and a first temperature. The low pressure water vapor generated is referred to as first water vapor. Since the first water vapor is generated from the system water, it is also referred to as an inner water vapor. The chill water $(L_H)_{12}$ is circulated through one or more air handlers 2*a*, 2*b*, in the rooms to cool the room air. The chill water is heated and becomes $(L_H)_{21}$ and recycled to the chillers. The first water vapor is absorbed into an absorbing solution at an elevated temperature and the heat of absorption is utilized to generate a second water vapor at a second pressure that is higher than the first pressure. The second water vapor is condensed by releasing heat of condensation to outside air or cooling water. Since the second vapor enters into a heat exchange relation with the environment such as with outdoor air or cooling water, it is also referred to as an outer water vapor. One may also use evaporative condensers in condensing the second vapor streams. In an evaporative condenser, water is applied on the condensing surfaces and heat of absorption is removed by vaporizing the water on the surface and the water vapor generated is carried away by the circulating air. The circulating air stream is both heated and humidified. An evaporation condenser may be considered as a combination of a condenser and a cooling tower. By using an evaporative condenser, the use of a cooling tower is not needed. The diluted absorbing solution is concentrated by an evaporation operation in an absorbing solution regenerator 3.

A VPE chiller may be divided into a multitude of pressure zones and multiple pressure zone operations may be used to conduct the flash vaporization, first vapor absorption, second vapor generation and second vapor condensation operations described. Such a VPE chiller may be referred to as a Vapor Pressure Enhancement Multiple Pressure Zone Direct Water Chiller and also referred as a VPE/MPZ Direct Water Chiller or simply as a VPE/MPZ chiller. Operations conducted in a multiple pressure zone chiller has many advantages over operations conducted in a single pressure zone chiller. These advantages are:

1. Temperature driving forces are more effectively utilized;
2. Thermodynamically, the operations are more efficient;
3. The concentration of the absorbing solution used is considerably lower;
4. The operating concentration range is much larger;
5. The coefficient of performance (C.O.P.) value is considerably higher.

FIG. 2 illustrates the structure and operations of a VPE/MPZ chiller. Five Pressure zone unit is illustrated. It comprises five pressure sub-zones, designated as Z-1 (3*a*), Z-2 (3*b*), Z-3 (3*c*), Z-4 (3*d*), and Z-5 (3*e*). There are flash vaporization sub-zone Z-En, a vapor pressure enhancement sub-zone Z-VPEn and a second vapor condensation sub-zone Z-Xn in each pressure sub-zone. Each vapor pressure enhancement sub-zone, Z-VPEn, comprises a first vapor absorption sub-zone Z-Jn and a second vapor generation sub-zone Z-Sn. Therefore, there are Z-En, Z-Jn, Z-Sn, Z-Xn sub-zones in Z-n pressure sub-zone, where n is 1 through 5.

In operation, a stream of system water $L_{01}$ recycled from air handlers is successively flash vaporized in Z-E1 4*a*, Z-E2 4*b*, Z-E3 4*c*, Z-E4 4*d*, and Z-E5 4*e* under successively lower pressures $(P_E)_1$, $(P_E)_2$, $(P_E)_3$, $(P_E)_4$ and $(P_E)_5$. First water vapor streams $V_{11}$, $V_{22}$, $V_{33}$, $V_{44}$, $V_{55}$ are generated and the water is successively chilled to become $L_{12}$, $L_{23}$, $L_{34}$, $L_{45}$, $L_{50}$. The final system chill water is circulated to the air handlers to remove heat from air and be heated and recycled back as $L_{01}$.

Since a flash vaporization operation is a near adiabatic operation involving a liquid phase and a vapor phase, it is also referred to as "an adiabatic liquid-vapor interaction." Similarly, a flash vaporization zone is also referred to as "an adiabatic liquid-vapor interaction zone."

A vapor pressure enhancement operation by absorption and an apparatus to be used therein have been described by Chen-Yen Cheng in U.S. Pat. No. 5,061,306. Such apparatus and operations are used in each vapor pressure enhancement sub-zone, designated as a VPEn sub-zone or Z-VPEn. A VPEn sub-zone comprises a first vapor absorption sub-zone and a second vapor generation sub-zone, respectively designated as Z-Jn sub-zone and Z-Sn sub-zone. A VPE sub-zone comprises a multitude of vertical heat conductive walls or flat tubes that separate the first vapor absorption sub-zone Z-Jn from the second vapor generation sub-zone Z-Sn. A falling film of an absorbing solution and a falling film of water are respectively applied on the two surfaces of each vertical wall. A stream of first vapor $V_{nn}$ is absorbed into the absorbing solution in Z-Jn sub-zone at a temperature higher than the saturation temperature of the first vapor. The absorbing solution is thereby diluted to become a weaker absorbing solution. The heat of absorption is transmitted through the vertical wall to vaporize water in Z-Sn sub-zone, generating a stream of second vapor $\overline{V}_{nn}$.

In the system illustrated, there are five vapor pressure enhancement sub-zones, designated as Z-VPE1 5*a*, and Z-VPE2 5*b*, Z-VPE3 5*c*, Z-VPE4 5*d*, Z-VPE5 5*e*. There are five first vapor absorption sub-zones, designated as Z-J1, Z-J2, Z-J3, Z-J4 and Z-J5 and five second vapor generation sub-zones, designated as Z-S1, Z-S2, Z-S3, Z-S4 and Z-S5 in these vapor pressure enhancement sub-zones.

In operation, a strong absorbing solution $J_{05}$ from a regenerator is introduced into Z-J5 sub-zone as falling film, a water stream $L_{55}$ is introduced into Z-S5 sub-zone as a falling film and the first vapor $V_{55}$ is brought in contact with the absorbing solution in Z-J5. The absorbing solution absorb the first vapor to become a weaker solution $J_{54}$ which is introduced in Z-J4 as a falling film. The heat of absorption is transmitted through the vertical wall to vaporize the water in Z-S5 to generated a second vapor $V_{55}$ at a pressure substantially higher than the saturation temperature of the first vapor $V_{55}$.

Similar operations are conducted in the other VPE sub-zones, Z-VPE4, Z-VPE3, Z-VPE2 and Z-VPE1. The operations conducted in all the VPE sub-zones may be summarized as follows:

1. Absorbing solution $J_{05}$ and water $L_{55}$ are respectively introduced into Z-J5 and Z-S5 to form falling films and first vapor $V_{55}$ is brought in contact with the absorbing solution in Z-J5. A weakened solution $J_{54}$ is formed and a second vapor $\overline{V}_{55}$ is generated.
2. Absorbing solution $J_{54}$ and water $L_{44}$ are respectively introduced into Z-J4 and Z-S4 to form falling films and first vapor $V_{44}$ is brought in contact with the absorbing solution in Z-J4. A weakened solution $J_{43}$ is formed and a second vapor $\overline{V}_{44}$ is generated.
3. Absorbing solution $J_{43}$ and water $L_{33}$ are respectively introduced into Z-J3 and Z-S3 to form falling films and first vapor $V_{33}$ is brought in contact with the absorbing solution in Z-J3. A weakened solution $J_{32}$ is formed and a second vapor $\overline{V}_{33}$ is generated.
4. Absorbing solution $J_{32}$ and water $L_{22}$ are respectively introduced into Z-J2 and Z-S2 to form falling films and first vapor $V_{22}$ is brought in contact with the absorbing solution in Z-J2. A weakened solution $J_{21}$ is formed and a second vapor $\overline{V}_{22}$ is generated.
5. Absorbing solution $J_{21}$ and water $L_{11}$ are respectively introduced into Z-J 1 and Z-S1 to form falling films and first vapor $V_{11}$ is brought in contact with the absorbing solution in Z-J1. A weakened solution $J_{10}$ is formed and a second vapor $\overline{V}_{11}$ is generated.

There are condensing sub-zone Z-X1 6*a*, Z-X2 6*b*, Z-X3 6*c*, Z-X4 6*d* and Z-X5 6*e* for condensing the second vapor streams $\overline{V}_{11}$, $\overline{V}_{22}$, $\overline{V}_{33}$, $\overline{V}_{44}$, $\overline{V}_{55}$ respectively. Outdoor air or cooling water may be used to remove the heat of condensation. It shows that outdoor air $G_{01}$ flow successively through the sub-zones to condense the second vapors $\overline{V}_{11}$, $\overline{V}_{22}$, $\overline{V}_{33}$, $\overline{V}_{44}$ and $\overline{V}_{55}$ and thereby from condensate streams $L_{11}$, $L_{22}$, $L_{33}$, $L_{44}$ and $L_{55}$ which are respectively recycled to Z-S1, Z-S2, Z-S3, Z-S4 and Z-S5 sub-zones. The air $G_{01}$ is heated successively to become $G_{12}$, $G_{23}$, $G_{34}$, $G_{45}$ and $G_{50}$. When outside air is used to provide the cooling, it is desirable to use heat transfer fins to enhance heat transfer.

One may use a cooling water stream $(L_c)_{01}$ instead of the outdoor air $G_{01}$. The cooling water is successively heated by removing the heat of condensation of the second vapor streams and becomes $(L_c)_{12}$, $(L_c)_{23}$, $(L_c)_{34}$, $(L_c)_{45}$ and $(L_c)_{50}$ The heated water $(L_c)_{50}$ is processed in a cooling tower to be cooled and returned as $(L_c)_{01}$. As has been described, one may also use evaporative condensers in condensing the second vapor streams.

Since each of these second vapor condensation zone has a heat interaction with the environment, such as with outdoor air or cooling water, it is also referred to as "an environmental heat interaction zone" or simply as "a heat interaction zone."

FIGS. 3 and 4 respectively illustrate a vertical cross-section. Section A—A , and a horizontal cross-section , Section B—B of a Type A VPE-MPZ Direct Water Chiller. Referring to these Figures, a Type A VPE-MPZ chiller comprises a vacuum enclosure 7 and multiple pressure processing sub-zones. In the figure, five processing sub-zones Z-1 (*7a*), Z-2 (*7b*), Z-3 (*7c*), Z-4 (*7d*) and Z-5 (*7e*) are illustrated. Each pressure sub-zone (Z-n) contains a water evaporation zone (Z-En) 8, a vapor pressure enhancing zone (Z-VPEn) 9, and a second vapor condensing zone (Z-Xn) 10.

There are one or more sets of rotating discs 11, two sets being shown, to provide water evaporating surfaces in the evaporation zone; there are flat tubes 12 made of heat conductive material for forming falling absorbing solution films and forming falling evaporating water films in the vapor pressure enhancing zone, there are condenser tubes 13 and heat transfer fins 14 in the condensation zone to condense the second vapor streams. There are vapor passages 15 for transferring vapor from the evaporation zone (Z-En) to the vapor pressure enhancing zone (Z-VPEn); there are vapor passages 16 for transferring vapor from the vapor pressure enhancing zone (Z-VPEn) to the vapor condensing zone (Z-Xn).There are a storage and a pumping device 17 for an absorbing solution and there are a storage and a pumping device 18 for water in each pressure zone. In each vapor pressure enhancing zone, there is a vapor absorption zone (Z-Jn) 19 and a second vapor generation zone (Z-Sn) 20. The former zone is the zone outside of the flat tubes 12 and the latter zone is the zone inside of the flat tubes 12. There is a pool of water 21 in the evaporation zone (Z-En) 8.

In operation, the vessel 7 is evacuated, system water $L_{01}$ is allowed to flow successively through Z-E1, Z-E2, Z-E3, Z-E4 and Z-E5, the rotating discs 11 is rotated to form water films on the disc surfaces, absorbing solution $J_{on}$ is introduced into storage tanks $J_n$, circulating pumps for circulating the absorbing solutions and water are activated to form falling films of absorbing solution and water in the absorption zones (Z-Jn) 19 and the second vapor generation zones (Z-Sn) 20. Outdoor air is blown through the heat transfer fins in the direction from Z-1 through Z-5.

Then, the system water $L_{01}$ flash vaporizer successively as it flows through Z-E1 to Z-E5 to form first vapors $V_{11}$, $V_{22}$, $V_{33}$, $V_{44}$ and $V_{55}$ and produces an system chill water $L_{50}$ which becomes the chill water $(L_H)_{12}$ of FIG. 1. It is circulated through the air handlers to cool the room air and be heated to become $(L_H)_{21}$ of FIG. 1. The heated chill water $(L_H)_{21}$ becomes the $L_{01}$ of the VPE/MPZ chiller. The first vapor $V_{nn}$ passes through the vapor passage 15 and is absorbed by the absorbing solution in the absorbing zone (Z-Jn) 19 and the heat of absorption is transmitted to the water in the falling water film in the second vapor generation zone (Z-Sn) 20 to generate second vapor $\overline{V}_{nn}$. The second vapor $\overline{V}_{nn}$ passes through the vapor passage 16 and is condensed in the condenser tubes 13. The heat of condensation is transmitted through the heat transfer fins 14 to the outdoor air. The outdoor air flows through the heat transfer fins in the direction from Z-X1 to Z-X2 and is heated and discharged.

As has been described, one may use cooling water to remove heats of condensing the second vapor streams; one may also use evaporative condensers in removing the heat of condensing the second vapor streams.

FIGS. 5 and 6 respectively illustrate a vertical cross-section taken perpendicular to the radial direction, Section A—A, and a vertical cross-section parallel to the longitudinal direction, Section B—B. of a Type B VPE-MPZ Direct Water Chiller. Referring to these figures, a Type B VPE-MPZ chiller comprises a horizontal vacuum enclosure 7 and multiple pressure processing sub-zones. In the Figures, five processing sub-zones Z-1 (*7a*), Z-2 (*7b*), Z-3 (*7c*), Z-4 (*7d*) and Z-5 (*7e*) are illustrated. Each pressure sub-zone (Z-n) contains a water evaporation zone (Z-En) 8, a vapor pressure enhancing zone (Z-VPEn) 9, and a second vapor condensing zone (Z-Xn) 10.

There are one or more sets of rotating discs 11, two sets being shown, to provide water evaporating surfaces in the evaporation zone; there are flat tubes 12 made of heat conductive material for forming falling absorbing solution films and forming falling evaporating water films in the vapor pressure enhancing zone; there are condenser tubes 13 in the condensation zone to condense the second vapor. There are vapor passages 15 for transferring vapor from the evaporation zone (Z-En) to the vapor pressure enhancing zone (Z-VPEn); there are vapor passages 16 for transferring vapor from the vapor pressure enhancing zone (Z-VPEn) to the vapor condensing zone (Z-Xn).There are a storage and a pumping device for absorbing solution and there are a storage and a pumping device for water in each pressure zone. These are not shown in the Figures. In each vapor pressure enhancing zone, there is a first vapor absorption zone (Z-Jn) 19 and a second vapor generation zone((Z-Sn) 20. The former zone is the zone outside of the flat tubes 12 and the latter zone is the zone inside of the flat tubes 12. There is a pool of water 21 in the evaporation zone (Z-En) 8.

In operation, the vessel 7 is evacuated, chill water $L_{01}$ is allowed to flow successively through Z-E1, Z-E2, Z-E3, Z-E4 and Z-E5, the rotating discs 11 is rotated to form water films on the disc surfaces, circulating pumps for circulating the absorbing solutions and water are activated to form falling films of absorbing solution and water in the absorption zones (Z-Jn) 19 and the second vapor generation zones (Z-Sn) 20. Cooling water is introduced into the condenser tubes 13.

Then the system water $L_{01}$ flash vaporizer successively as it flows through Z-E1 to Z-E5 to form first vapors $V_{11}$, $V_{22}$, $V_{33}$, $V_{44}$ and $V_{55}$ and produces a system chill water $L_{50}$ which becomes the chill water $(L_H)_{12}$ of FIG. 1. It is circulated through the air handlers to cool the room air and be heated to become $(L_H)_{21}$ of FIG. 1. The heated chill water $(L_H)_{21}$ becomes the $L_{01}$ of the VPE/MPZ chiller. The first vapor $V_{nn}$ passes through the vapor passage 15 and is absorbed by the absorbing solution in the absorbing zone (Z-Jn) 19 and the heat of absorption is transmitted to the water in the falling water film in the second vapor generation zone (Z-Sn) 20 to generate second vapor $\overline{V}_{nn}$. The second vapor $\overline{V}_{nn}$ passes through the vapor passage 16 and is condensed outside of the condenser tubes 13. The heat of condensation is transmitted through the condenser tubes to the cooling water inside. The cooling water flows inside the tubes in the direction from Z-X1 to Z-X5 and is heated. The heated cooling water is processed in a cooling tower and returned to the chiller.

A VPE heater may be divided into a multitude of pressure zones and multiple pressure zone operations may be used to conduct the heat interactions with the environment, such as with outdoor air or other low temperature heat sources, to produce outer water vapor, absorption of the outer vapor, generation of inner vapor and adiabatic condensation of the inner vapor into system water. Such a VPE water heater may be referred to as a Vapor Pressure Enhancement Multiple Pressure Zone Direct Water Heater and also refer to as a VPE/MPZ Direct Water Heater or simply as a VPE/MPZ heater. Operations conducted in a multiple pressure zone VPE-heater have may advantages over operations conducted in a single pressure zone VPE-heater. These advantages are similar to the advantages of a multiple pressure zone VPE-chiller over a single pressure zone VPE-chiller. Therefore, a detail description of these advantages is omitted.

FIG. 7 illustrates the structure and operations of a VPE/MPZ heater. Five pressure zone unit is illustrated. It comprises five pressure sub-zones, designated as Z-1 (22*a*) through Z-5 (22*e*). There are adiabatic liquid-vapor interaction zones, designated as Z-E1 (23*a*) through Z-E5 (23*e*); there are vapor pressure enhancement zones, designated as Z-VPE1 (24*a*) through Z-VPE5 (24*e*); there are environmental heat interaction zones, designated as Z-X1 (25*a*) through Z-X5 (25*e*). Each vapor pressure enhancement sub-zone, Z-VPEn, comprises an outer vapor absorption sub-zone Z-Jn and an inner vapor generation sub-zone Z-Sn. Therefore, there are outer vapor absorption zones, designated as Z-J1 through Z-J4 zones and inner vapor generation zones, designated as Z-S1 through Z-S5.

The structure of the system illustrated in FIG. 7 is very similar to that the system illustrated by FIG. 2. There are rotating discs in Z-E1 through Z-E5 to provide liquid-vapor interface areas; there are flat tubes for forming liquid films of absorbing solution and falling water films; there are heat transfer tubes in Z-X1 through Z-X5 for receiving heat from the environment and evaporating water.

In operation, water is added to Z-X1 through Z-X5, water is added to Z-S1 through Z-S5, absorbing solution $J_{05}$ is introduced into Z-J5 and diluted absorbing solutions are successively introduced into Z-J4 through Z-J1 as $J_{54}$ through $J_{21}$ and finally discharged from Z-J1 as $J_{10}$. The absorbing solutions from falling films in Z-J1 through Z-J5 and water forms falling films in Z-S1 through Z-S5. System water flows through Z-1 to Z-5. Then the following operations take place:

1. Outer water vapor streams $V_{11}$ through $V_{55}$ are generated in Z-X1 through Z-X5;
2. The outer water vapor streams are absorbed into absorbing solutions in Z-J1 through Z-J5;
3. Water is vaporized in Z-S1 through Z-S5 upon receiving heat of absorption from Z-J1 through Z-J5, generating inner water vapor streams $\overline{V}_{11}$ through $\overline{V}_{55}$;
4. The inner water vapor streams $\overline{V}_{11}$ through $\overline{V}_{55}$ condenses by interacting with system water to heat the system water successively. The system water is heated successively, $L_{01}$ through $L_{50}$, as it flows through Z-E1 to Z-E5.

The vapor pressure enhancement operations are similar to those described by referring to FIG. 2.

Z-X1 zone through Z-X5 zone are referred to as "environmental heat interaction zones" or simply as "heat interaction zones" and the operations conducted in these zones are referred to as "environmental heat interactions" or simply as "heat interactions". Z-E1 through Z-E5 are referred to as "adiabatic liquid-vapor interaction zones" and the operations conducted in these zones are referred to as "adiabatic liquid-vapor interactions" or "adiabatic condensation into system water". Since water is vaporized in Z-X1 through Z-X5 by receiving heat from the environment, such as outdoor air, the vapor streams generated, $V_{11}$ through $V_{55}$ are referred to as outer water vapor streams. Since the water vapor streams, $\overline{V}_{11}$ through $\overline{V}_{55}$, are condensed by adiabatic interactions with the system water and become part of the heated system water, they are referred to as inner water vapor. Since the outer water vapor $V_{nn}$ and inner water vapor $\overline{V}$nn in a pressure zone Z-n are respectively the inlet vapor and outlet vapor of the vapor pressure enhancement operation in Z-VPEn, they are referred to respectively as the first vapor and second vapor in reference to the VPE operation.

FIGS. 8 and 9 respectively illustrate a vertical cross-section. Section A—A, and a horizontal cross-section, Section B—B of a Type A VPE-MPZ Direct Water Heater. Referring to these Figures, a Type A VPE-MPZ heater comprises a vacuum enclosure 26 and multiple pressure processing sub-zones. In the figure, five processing sub-zones Z-1(26*a*), Z-2(26*b*), Z-3(26*c*), Z-4(26*d*) and Z-5(26*e*) are illustrated. Each pressure sub-zone (Z-n) contains an adiabatic liquid-vapor interaction zone (Z-En) 27, a vapor pressure enhancement zone (Z-VPEn) 28, and an environmental heat interaction zone (Z-Xn) 29.

There are one or more rotating discs 30, two sets being shown, to provide interfacial areas in the adiabatic liquid-vapor interaction Zone (Z-En) 27; there are flat tubes 31 made of heat conductive material for forming falling absorbing solution films and forming falling and evaporating water films in the vapor pressure enhancing zone; there are heat transfer tubes 32 and heat transfer fins 33 in the heat interaction zone (Z-Xn) 29 to generate the outer vapor streams. There are vapor passages 34 for transferring vapor from the vapor pressure enhancing zone (Z-VPEn) 28 to the adiabatic liquid-vapor interaction zone (Z-En) 27; there are vapor passages 35 for transferring outer vapor from the heat interaction zone (Z-Xn) 29 to the vapor pressure enhancement zone (Z-VPEn) 28. There are a storage and a pumping device 36 for an absorbing solution and there are a storage and a pumping device 37 for water in each pressure zone. In each vapor pressure enhancing zone, there is a vapor absorption zone (Z-Jn) 39 and a inner vapor generation zone (Z-Sn) 38. The former zone is the zone inside of the flat tubes 31 and the latter zone is the zone outside of the flat tubes 31. There is a pool of water 40 in the adiabatic liquid-vapor interaction zone (Z-En) 27.

In operation, the vessel 26 is evacuated, system water $L_{01}$ is allowed to flow successively through Z-E1, Z-E2, Z-E3, Z-E4 and Z-E5, the rotating discs 30 is rotated to form water films on the disc surfaces, absorbing solution $J_{on}$ is introduced into storage tanks $J_n$ circulating pumps for circulating the absorbing solutions and water are activated to form falling films of absorbing solution and water in the absorption zone (Z-Jn) 39 and the inner vapor generation zones (Z-Sn) 38. Water is added to the heat transfer tubes 32 to form falling water films and outdoor air is blown through the heat transfer fins in the direction from Z-1 through Z-5. Then the following operations take place:

1. Water vaporizes in Z-X1 through Z-X5 to generate outer water vapors $V_{11}$ through $V_{55}$;
2. The outer water vapor streams are absorbed into the absorbing solution in Z-VPE1 through Z-VPE5;
3. The heats of absorption generated in Z-J1 through Z-J5 are transferred to Z-S1 through Z-S5 to generate inner water vapor streams $\overline{V}_{11}$ through $\overline{V}_{55}$;
4. The inner water vapor streams are condensed by adiabatically interacting with system water in Z-E1 through Z-E5 to heat the system water $L_{01}$ successively to become heated system water $L_{50}$.

One may construct and operate a Type B VPE-MPZ Direct Water Heater. Its structure is similar to that of a VPE-MPZ Direct Water Chiller illustrated by FIG. 5 and 6 and the operations are similar to those described in connection with the Type A VPE-MPZ heater described. Therefore, a detail description of Type B VPE-MPZ is omitted.

Since the structure and operations of a VPE-heater and a VPE-chiller are very close, one can construct and operate a dual purpose VPE chiller/heater.

What are claimed are as follows:

1. A process of transforming a stream of system water into a product stream of chilled water or a product stream of heated water that comprises 1. A first step of subjecting the water stream to an adiabatic liquid-vapor interaction of (a) flash vaporizing the water under a low pressure to thereby generate a first low pressure vapor, referred to as an inner water vapor and produce the chill water, or (b) bringing the system water in contact with a water vapor, referred to as an inner water vapor, to thereby condense the water vapor and produce the heated water;

2. A second step of entering a heat interaction with the environment to (a) condense a water vapor, referred to as an outer water vapor by rejecting heat of condensation to the environment, or (b) vaporize water to generate a water vapor, referred to as an outer water vapor by receiving heat from the environment, 3. A third step of subjecting the inner water vapor and the outer water vapor to an absorption vapor pressure enhancement operation of (a) absorbing the inner water vapor into an absorbing solution and transfer the heat of absorption through a heat conductive wall to vaporize water and thereby generate the outer water vapor, the pressure of the outer water vapor being substantially higher than the pressure of the inner water vapor, or (b) absorbing the outer water vapor into an absorbing solution and transfer the heat of absorption through a heat conductive wall to vaporize water and generate the inner water vapor, the pressure of the inner water vapor being substantially higher than the pressure of the outer water vapor.

2. A process of claim 1, wherein the product stream is chilled water and is characterized in that:

1. The first step is a flash vaporization operation to thereby generate the inner water vapor;
2. The third step comprises a sub-step of absorbing the inner water vapor into the absorbing solution and a sub-step of utilizing the heat of absorption to generate the outer water vapor;
3. The second step is condensation of the outer water vapor by rejecting heat of condensation to the environment.

3. A process of claim 2, wherein the process is conducted in multiple pressure zones, successively designated as Z-1 through Z-N zones and is characterized in that:

1. Each pressure zone Z-n comprises a flash vaporization zone Z-En, a vapor pressure enhancement zone Z-VPEn and vapor condensation zone Z-Xn;
2. The vapor pressure enhancement zone Z-VPEn comprises an inner water vapor absorption zone Z-Jn and an outer water vapor generation zone Z-Sn;
3. System water flows successively through Z-En zones in the direction from Z-E1 to Z-EN and the absorbing solution flows successively through Z-Jn zones in the direction from Z-JN to Z-J1;
4. The inner water vapor generated in a given pressure zone Z-En is subjected to the vapor pressure enhancement operation conducted in Z-VPEn zone to generate outer water vapor and the outer water vapor is condensed in the heat interaction zone Z-Xn.

4. A process of claim 3, wherein the outer water vapor is condensed in Z-X zone by rejecting heat to the outdoor air.

5. A process of claim 3, wherein the outer water vapor is condensed in Z-X zone by rejecting heat to a cooling water stream.

6. A process of claim 3, wherein the outer water vapor is condensed by an evaporative cooling operation.

7. A process of claim 1, wherein the product stream is heated water and is characterized in that:

1. The second step is vaporization of water by receiving heat from the environment to thereby generate the outer water vapor;
2. The third step comprises a sub-step of absorbing the outer water vapor into an absorbing solution and a sub-step of utilizing the heat of absorption to generate the inner water vapor;
3. The first step is an adiabatic interaction of the inner water vapor with the system water to thereby simultaneous condense the inner water vapor and raise the temperature of the system water.

8. A process of claim 7, wherein the process is conducted in multiple pressure zones, successively designated as Z-1 through Z-N zones and is characterized in that:

1. Each pressure zone Z-n comprises an adiabatic liquid-vapor interaction zone Z-En, a vapor pressure enhancement zone Z-VPEn and an environmental heat interaction zone Z-Xn;
2. The vapor pressure enhancement zone Z-VPEn comprises an outer water vapor absorption zone Z-Jn and an inner water vapor generation zone Z-Sn;
3. System water flows successively through Z-En zones in the direction from Z-E1 to Z-EN and the absorbing solution flows successively through Z-Jn zones in the direction from Z-JN to Z-J1;
4. The outer water vapor generated in a given pressure zone Z-Xn is subjected to the vapor pressure enhancement operation in Z-VPEn zone to generate inner water vapor and the inner water vapor enters into an adiabatic liquid-vapor interaction with the system water in zone E-n to condense therein and raise the system water temperature.

9. A process of claim 8, wherein water is vaporized in Z-X zone to generate the outer water vapor by receiving heat from the outdoor air.

10. A process of claim 8, wherein water is vaporized in Z-X zone to generate the outer water vapor by receiving heat from a water stream.

11. An apparatus for transforming a stream of system water into a product stream of chilled water or a product stream of heated water that comprises:

1. An adiabatic liquid-vapor interaction zone, designated as Z-E zone, having means for providing liquid-vapor interfacial areas for bringing system water in direct contact interaction with an inner water vapor that is
   (a) flash vaporization of the system water under a low pressure to thereby generate a low pressure inner water vapor and produce the chilled water or
   (b) condensation of an inner water vapor by direct contact heat interaction with the system water to produce the heated water;
2. An environmental heat interaction zone, designated as Z-X zone, provided with heat transfer tubes to receive heat from the environment or reject heat to the environment to thereby
   (a) condense an outer water vapor, or
   (b) generate an outer water vapor;
3. A vapor pressure enhancement zone, designated as Z-VPE zone, that comprises a vapor absorption zone, designated as Z-J zone, and a vapor generation zone, designated as Z-S zone, to thereby
   (a) absorb the inner water vapor and generate the outer water vapor, or
   (b) absorb the outer water vapor and generate the inner water vapor.

12. An apparatus of claim 11, wherein the product stream is chilled water and is characterized in that:

1. Flash vaporization of system water takes place in the Z-E zone;
2. Condensation of the outer water vapor takes place in the Z-X zone;
3. Absorption of the inner water vapor and generation of the outer water vapor take place in the Z-VPE zone.

13. An apparatus of claim 12, wherein the apparatus comprises multiple pressure zones, successively designated as Z-1 through Z-N and is characterized in that:

1. Each pressure zone Z-n comprises a flash vaporization zone Z-En, a vapor pressure enhancement zone Z-VPEn and vapor condensation zone Z-Xn;
2. The vapor pressure enhancement zone Z-VPEn comprises an inner water vapor absorption zone Z-Jn and an outer water vapor generation zone Z-Sn;
3. System water flows successively through Z-En zones in the direction from Z-E1 to Z-EN and the absorbing solution flows successively through Z-Jn zones in the direction from Z-JN to Z-J1;
4. The inner water vapor generated in a given pressure zone Z-En is subjected to the vapor pressure enhancement operation conducted in Z-VPEn zone to generate outer water vapor and the outer water vapor is condensed in the heat interaction zone Z-Xn.

14. An apparatus of claim 13 wherein the outer water vapor is condensed in Z-X zone by rejecting heat to the outdoor air.

15. An apparatus of claim 13 wherein the outer water vapor is condensed in Z-X zone by rejecting heat to a cooling water stream.

16. An apparatus of claim 13 wherein the outer water is condensed by an evaporative cooling operation.

17. An apparatus of claim 11, wherein the product stream is heated water and is characterized in that:

1. Adiabatic condensation of the inner water vapor into the system water takes place in the Z-E zone;
2. Generation of the outer water vapor take place in the Z-X zone;
3. Absorption of the outer water and generation of inner water vapor take place in the Z-VPE zone.

18. An apparatus of claim 17, wherein the apparatus comprises multiple pressure zones, successively designated as Z-1 through Z-N and is characterized in that:

1. Each pressure zone Z-n comprises an adiabatic liquid-vapor interaction zone Z-En, a vapor pressure enhancement zone Z-VPEn and an environmental heat interaction zone Z-Xn,
2. The vapor pressure enhancement zone Z-VPEn comprises an outer water vapor absorption zone Z-Jn and an inner water vapor generation zone Z-Sn;
3. System water flows successively through Z-En zones in the direction from Z-E1 to Z-EN and the absorbing solution flows successively through Z-Jn zones in the direction from Z-JN to Z-J1;
4. The outer water vapor generated in a given pressure zone Z-Xn is subjected to the vapor pressure enhancement operation in Z-VPEn zone to generate inner water vapor and the inner water vapor enters into an adiabatic liquid-vapor interaction with the system water in zone E-n to condense therein and raise the system water temperature.

19. An apparatus of claim 18, wherein water is vaporized in Z-X zone to generate the outer water vapor by receiving heat from the outdoor air.

20. An apparatus of claim 18, wherein water is vaporized in Z-X zone to generate the outer water vapor by receiving heat from a water stream.

* * * * *